US005564952A

United States Patent [19]

Davis

[11] Patent Number: 5,564,952

[45] Date of Patent: Oct. 15, 1996

[54] ELECTRICAL PLUG CONNECTOR WITH BLADE RECEIVING SLOTS

[75] Inventor: Wayne S. Davis, Harrisburg, Pa.

[73] Assignee: The Whitaker Corporation, Wilmington, Del.

[21] Appl. No.: 363,158

[22] Filed: Dec. 22, 1994

[51] Int. Cl.[6] ..... H01R 23/02

[52] U.S. Cl. ..... 439/682; 439/692; 439/746; 439/749

[58] Field of Search ..... 439/682, 692, 439/694, 733, 746, 748, 749

[56] References Cited

U.S. PATENT DOCUMENTS

| | | | |
|---|---|---|---|
| 3,075,167 | 1/1963 | Kinkaid | 439/749 |
| 3,732,529 | 5/1973 | Weisenburger | 339/192 R |
| 4,101,192 | 7/1978 | Bauerle et al. | 439/746 |
| 4,175,821 | 11/1979 | Hunter | 339/258 R |
| 4,401,356 | 8/1983 | Bare | 339/258 R |
| 4,753,605 | 6/1988 | DeYoung | 439/347 |
| 4,772,229 | 9/1988 | Nix et al. | 439/733 |
| 4,932,906 | 6/1990 | Kaley et al. | 439/857 |
| 4,993,959 | 2/1991 | Randolph | 439/881 |
| 5,004,434 | 4/1991 | Aiello et al. | 439/746 |
| 5,024,610 | 6/1991 | French et al. | 439/857 |

*Primary Examiner*—P. Austin Bradley
*Assistant Examiner*—T. C. Patel
*Attorney, Agent, or Firm*—Anton P. Ness

[57] ABSTRACT

An electrical connector (18) comprises, an insulating housing (19), a front portion of the housing (19) comprising an elongated plug (21), elongated cavities (23) bridging transversely across the plug (21), a mouth (25) of each of the cavities opening into an elongated, blade receiving, narrow slot (22), each narrow slot (22) intersecting a corresponding one of the cavities (23), a conducting electrical contact (20) in each of the cavities (23), each of the contacts (20) having thin leaf sides (29) on a blade receiving receptacle, each receptacle being positioned beneath a corresponding narrow slot (22), and edges on respective thin leaf sides (29) being overlapped by undercut shelves (27) along an intersection of the narrow slots (22) with respective cavities (23).

4 Claims, 4 Drawing Sheets

ELECTRICAL PLUG CONNECTOR WITH BLADE RECEIVING SLOTS

FIELD OF THE INVENTION

The invention relates to an electrical connector with blade receiving contacts, and more particularly, to an electrical connector with multiple, blade receiving contacts in an insulating plug portion of the connector.

BACKGROUND OF THE INVENTION

According to U.S. Pat. No. 5,024,610, a spring electrical contact is constructed with arched fingers projecting from an edge of a contact body. A silo encircles the contact to shield the contact from accidental touching. Multiple contacts are encircled by respective multiple silos, causing difficulty in aligning the multiple silos with corresponding, multiple, silo receiving openings in a mating electrical connector.

SUMMARY OF THE INVENTION

The invention solves a problem of providing multiple contacts transversely in an insulating plug on an insulating housing. The plug eliminates multiple silos, and is easily mated in a plug receiving cavity of a mating electrical connector. The plug additionally is provided with enlarged mouths that receive and guide mating electrical contacts into narrow slots in the plug.

According to an embodiment of the invention, an electrical connector comprises, an insulating housing, a front portion of the housing comprising an elongated plug, elongated cavities bridging transversely across the plug, a mouth of each of the cavities comprising an elongated, blade receiving, narrow slot, each narrow slot intersecting a corresponding one of the cavities, a conducting electrical contact in each of the cavities, each of the contacts having thin leaf sides on a blade receiving receptacle, each receptacle being positioned beneath a corresponding narrow slot, and edges on respective thin leaf sides being overlapped by undercut shelves along an intersection of the narrow slots with respective cavities.

An embodiment of the invention will now be described by way of example with reference to the accompanying drawings, according to which:

DETAILED DESCRIPTION

Figure 7:
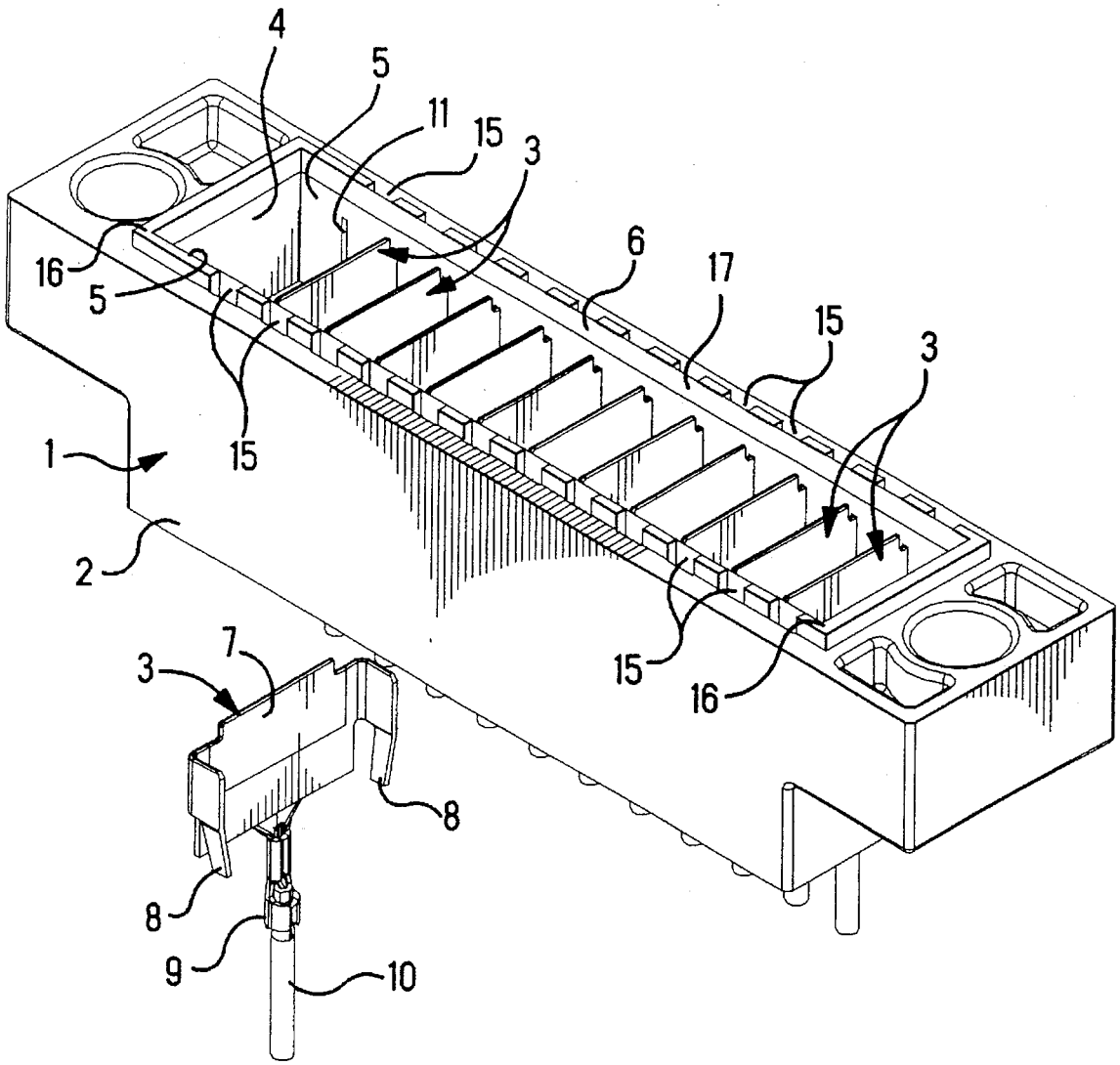
FIG. 7 is an isometric view of a mating electrical connector with parts separated from one another.

With reference to FIG. 7, an electrical connector 1 comprises, a unitary insulating housing 2, and conductive multiple contacts 3 in the housing 2, the contacts 3 are spaced apart without insulation therebetween, the contacts 3 bridge across a single cavity 4 in the housing 2 to opposite sides 5 of the single cavity 4, and the contacts 3 are latched to each opposite side 5 of the single cavity 4. The cavity 4 comprises, an elongated, plug receiving, single cavity in a mating front 6 of the housing 2. The single cavity 4 is without interior walls or channels providing insulation for separating the contacts 3 from one another within the single cavity 4.

Each of the contacts 3 is of unitary construction, stamped and formed from a thin metal plate, and comprises, an elongated blade 7, and projecting narrow lances 8 on opposite sides of the blade 7. Each of the blades 7 is a single thickness. The blade 7 extends from an edge of the plate. The lances 8 extend from an edge of the plate, and are bent to project out of a thickness plane of the blade 7. The lances 8 project at respective angles with respect to the blade 7. The lances 8 on each blade 7 are bent to extend at the respective angles. A wire connecting terminal 9 projects from an edge of the plate, and is formed into a barrel shape to encircle and connect to an insulated wire 10.

Figure 1:
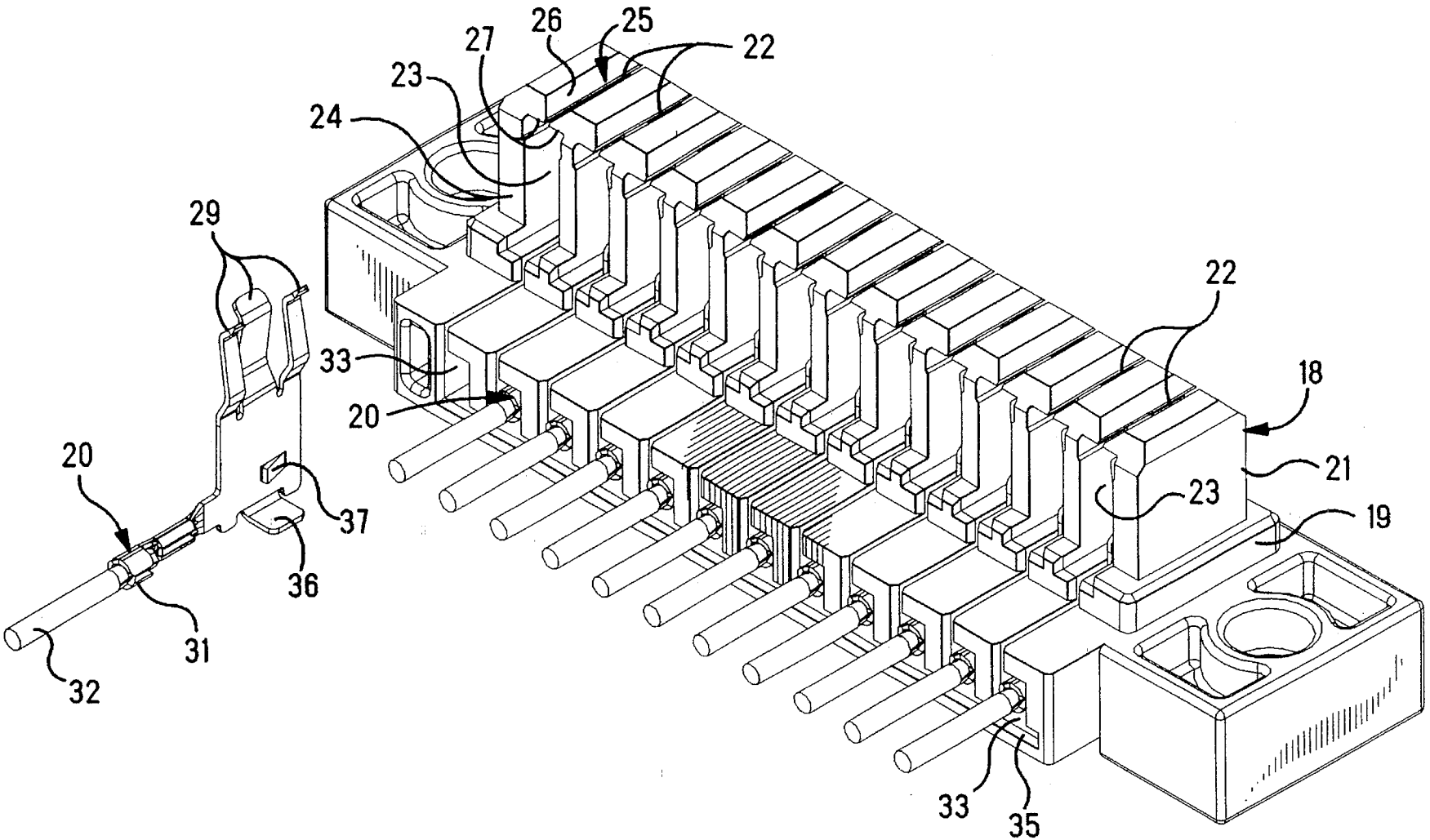
FIG. 1 is an isometric view of an electrical connector and electrical contacts, with parts separated from one another.

With reference to FIG. 1, a mating plug type electrical connector 18 comprises a unitary insulating housing 19 and multiple electrical contacts 20 in the housing 19. The single cavity 4 and the multiple contacts 3 are adapted to receive a single insulative plug 21 comprising a front portion of the housing 19 of the mating electrical connector 18. The plug 21 is mated to the connector 1 by insertion of the plug 21 into the cavity 4, and by receipt of elongated, blade receiving, narrow slots 22 extending transversely across and in the plug 21. The insulation of the plug 21 on the mating connector 18 separates the blades 7 from one another in the connector 1. The plug 21 is a single block with chamfered edges on the front, which provides a monolithic block that easily enters the single cavity 4.

Elongated contact receiving cavities 23 bridge transversely across the plug 21 and open into an exterior side 24 of the plug 21. Each cavity 23 intersects a corresponding slot 22. Each slot 22 opens into an enlarged elongated mouth 25 having inward facing, opposite beveled edges 26. When the plug 21 enters the cavity 4 of the connector 1, the beveled edges 26 on the mouth 25 funnel and guide a corresponding blade 7 on the connector 1 into a corresponding slot 22 of the mating connector 18. The plug 21 separates the blades 7 from one another and insulates each of the blades 7. Undercut shelves 27 on the housing are along opposite sides at an intersection of each narrow slot 22 with a corresponding cavity 24.

Figure 6:
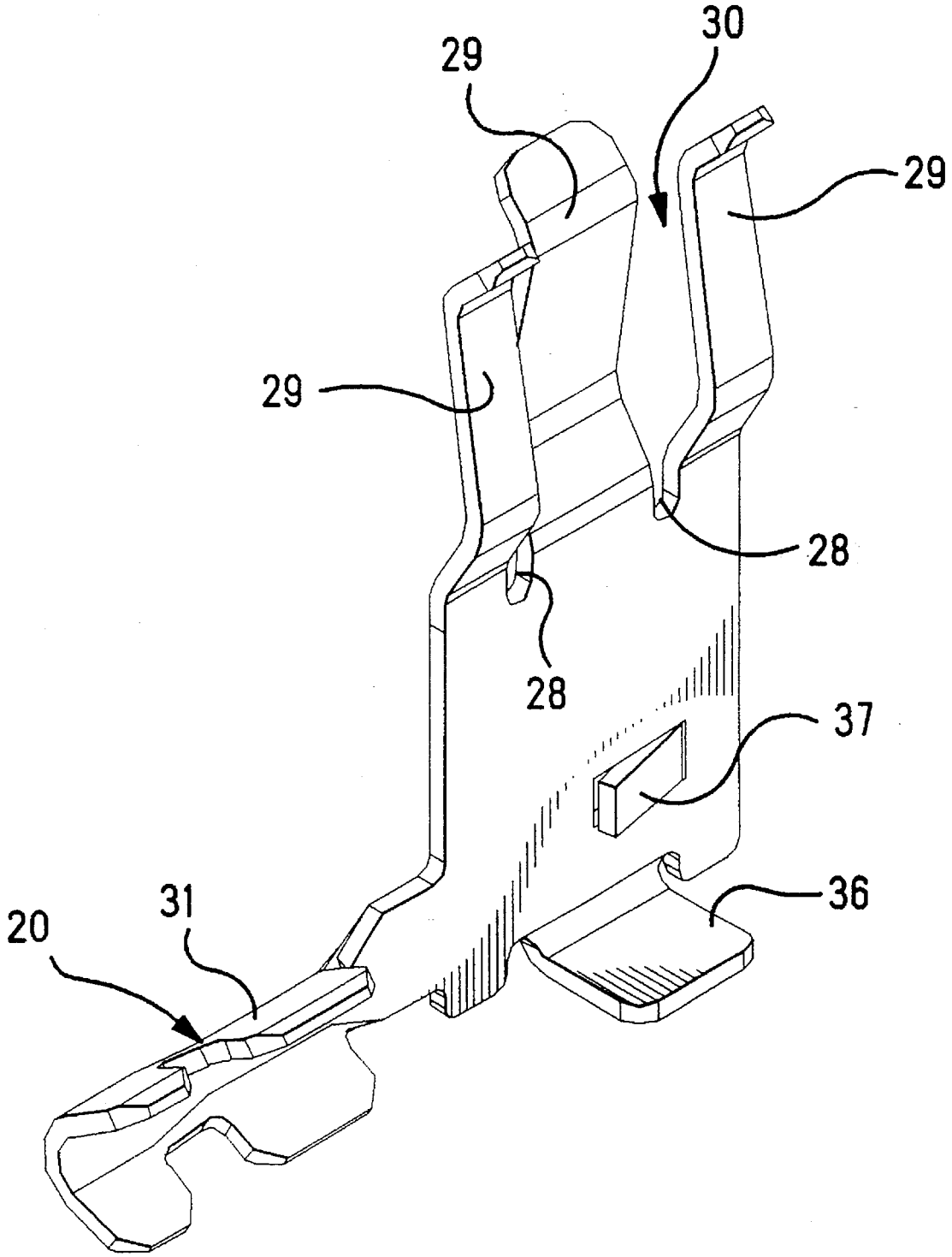
FIG. 6 is an isometric view of an electrical contact as shown in FIG. 1.

With reference to FIGS. 1 and 6, the connector 18 further comprises, a corresponding electrical contact 20 in each of the cavities 24. Each of the contacts 20 is stamped and formed from a unitary, thin metal plate. Each plate is received along a narrow portion of a corresponding cavity 23. Each of the contacts 20 is intersected by slits 28 extending into one edge. The slits 28 divide the one edge into a series of elongated, thin leaf sides 29 that project from the one edge. Alternate ones of the thin leaf sides 29 are arched in opposite directions to project out of a thickness plane of the thin, metal plate. A blade receiving receptacle 30 is defined along an imaginary straight plane extending between the arched sides 29. Each receptacle 30 is positioned beneath a corresponding narrow slot 22. Edges on tips of respective thin leaf sides 29 are overlapped by the undercut shelves 27 on the housing 23 along an intersection of each narrow slot 22 with a corresponding cavity 24. Each cavity 24 and associated slot 22 have closed ends resisting further movement of the contacts 20 in a forward direction along the cavity 24. When the connectors 1 and 18 are mated, each of the blades 7 of the contacts 3 will enter a corresponding blade receiving receptacle 30 along the imaginary straight plane. End portions of the thin leaf sides 29 are bent reversely toward the thickness plane to be resiliently biased by frictional engagement with a corresponding blade 7. The spring forces of the receptacle 30 is divided equally on opposite sides of the blade 7. This is accomplished by allocating the cumulative sizes of the thin leaf sides 29 equally on opposite sides of the receptacle 30. For example, as shown in FIG. 6, the cumulative size of a single thin leaf side 29 arched in one direction, equals the cumulative sizes of two thin leaf sides 29 arched in an opposite direction.

With reference to FIG. 6, each contact 20 further comprises, a wire connecting terminal 31 projecting from a corresponding plate. The terminal 31 is formed into a barrel portion encircling and connecting with an insulated wire 32 FIG. 1. Each terminal 31 and corresponding wire 32 connected to the terminal 31 are received along a terminal receiving opening 33 intersecting one of the cavities. Boot portions 34 on the housing 18 encircle and support respective terminals 31 and corresponding wires 32 received in the openings 33.

With reference to FIG. 1, elongated slots 35 open into an exterior side of the housing 23 and extend transversely to communicate with an interior side of a corresponding cavity 24. Each contact 20 further comprises, a tab 36 that projects outwardly transverse of a thickness of the thin plate and registers along a corresponding transverse slot 35. The tab 36 in the slot 35 is supported by the housing 18. The transversely extending tab 36 in the slot 35 resists rotation of the contact 20.

Figure 2:
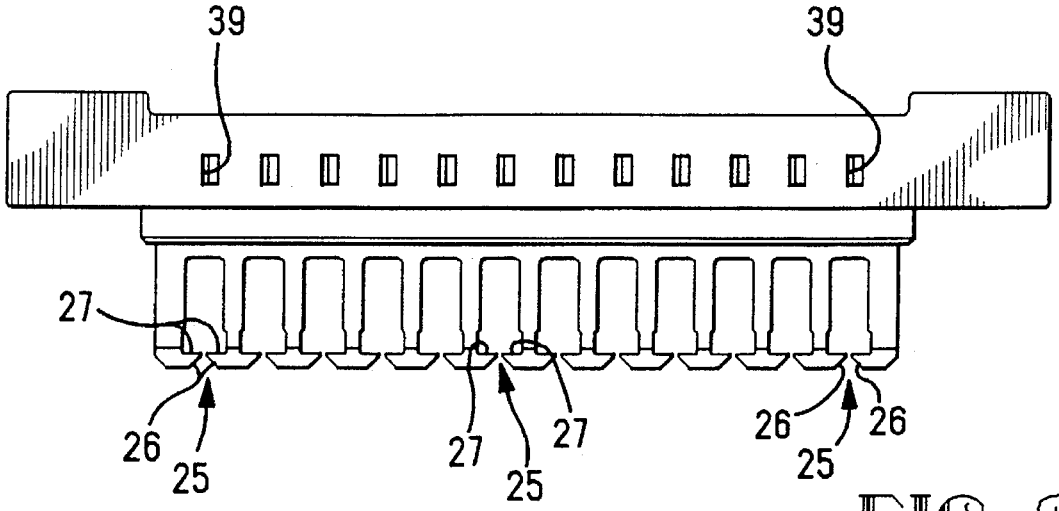
FIG. 2 is a side view of a housing of the connector shown in FIG. 1.
Figure 3:
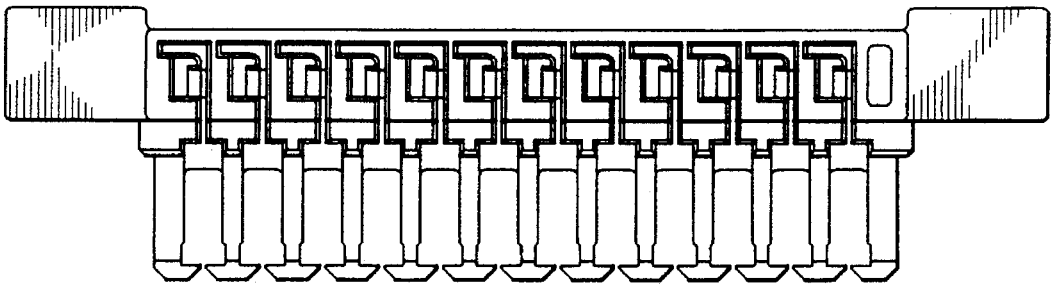
FIG. 3 is a side view of a housing as shown in FIG. 2.
Figure 4:
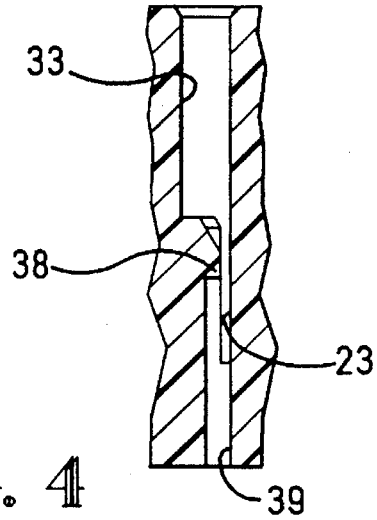
FIG. 4 is an enlarged fragmentary view of a portion of the housing shown in FIGS. 2 and 3, with parts cut away.
Figure 5:
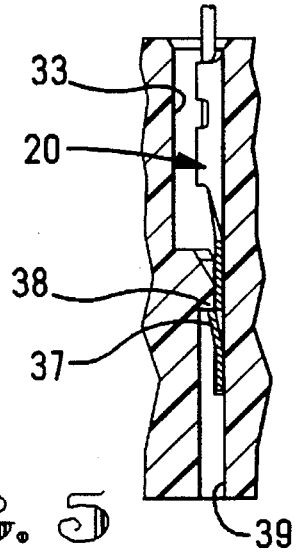
FIG. 5 is a view similar to FIG. 4, and illustrating an electrical contact in the housing as shown in FIG. 4.

With reference to FIG. 6, a diagonally projecting lance 37 is struck out of the thickness of each plate. A projecting latch 38 unitary with the housing 19 projects in an interior of each contact receiving cavity 23. As shown in FIGS. 2, 4 and 5, a narrow core pin passage 39 in the housing 19 intercepts each contact receiving cavity 23. The passages 39 intercept the cavities 23 during a molding process to form the latches 38 in the interiors of the cavities 23. The lance 37 is resiliently deflected inward of the plate to pass beyond the latch 38. Once past the latch 38 the lance deflects outwardly to latch against the latch 38, and to resist withdrawal or movement of the contact 20 in a rearward direction.

Other embodiments and modifications of the invention are intended to be covered by the spirit and scope of the appended claims.

I claim:

1. An electrical connector for mating with a connector having a plurality of parallel blade contacts arrayed within a plug receiving cavity, comprising:

an insulating housing, a front portion of the housing comprising an elongated plug, a plurality of parallel elongated cavities bridging transversely across the plug, a mouth of each of the cavities comprising a respective elongated, blade receiving, narrow slot, each said narrow slot communicating with a corresponding one of the cavities and aligned therewith, a conductive electrical contact in each of the cavities, each of the contacts having thin leaf sides on a blade receiving receptacle, each receptacle being positioned beneath and aligned with a corresponding narrow slot such that contact surfaces defined on said thin leaf sides are parallel with said narrow slot to be engaged with opposed side surfaces of a respective said blade contact inserted thereinto and substantially parallel to direction of insertion of the contact into a respective one of the cavities, and edges on respective thin leaf sides being overlapped by undercut shelves along an intersection of the corresponding narrow slot with the respective cavity.

2. An electrical connector as recited in claim 1 wherein, an elongated slot communicates in an interior side of each of the cavities, each contact comprises a thin plate, a tab projects outwardly of a thickness of the thin plate and registers along a corresponding slot, and the thin leaf sides on each receptacle project from an edge of a corresponding thin plate.

3. An electrical connector as recited in claim 1 wherein, the thin leaf sides on each receptacle extend from an edge of a thin plate, each thin plate is received along a plate receiving, narrow slot intersecting one of the cavities.

4. An electrical connector as recited in claim 1 wherein, each contact comprises a wire connecting barrel portion projecting from a corresponding plate, and each barrel portion is received along a barrel receiving opening intersecting one of the cavities.

* * * * *